US005344030A

United States Patent [19]

Evenson

[11] Patent Number: 5,344,030

[45] Date of Patent: Sep. 6, 1994

[54] EXPANDABLE MODULAR WALL FILE WITH HIDDEN ATTACHMENT AND SUPPORT MEANS

[75] Inventor: Mel Evenson, Rancho Palos Verdes, Calif.

[73] Assignee: Rubbermaid Office Products Group, Inc., Inglewood, Calif.

[21] Appl. No.: 105,894

[22] Filed: Aug. 11, 1993

[51] Int. Cl.[5] ..... A47F 5/00

[52] U.S. Cl. ..... 211/55; 211/88

[58] Field of Search ..... 211/55, 128, 88, 56; D6/573, 567; D19/90, 91, 92

[56] References Cited

U.S. PATENT DOCUMENTS

| | | | |
|---|---|---|---|
| D. 257,752 | 1/1981 | Rabig . | |
| D. 276,777 | 12/1984 | Evenson . | |
| D. 277,396 | 1/1985 | Mahler . | |
| D. 295,638 | 5/1988 | Evenson . | |
| D. 311,028 | 10/1990 | Evenson . | |
| D. 332,971 | 2/1993 | Evenson . | |
| 782,738 | 2/1905 | Faust . | |
| 1,749,576 | 11/1928 | Evans . | |
| 2,573,348 | 10/1946 | Meadows . | |
| 3,002,666 | 9/1958 | Silverman . | |
| 3,286,850 | 11/1964 | Ruhnke . | |
| 3,516,634 | 1/1968 | Salava et al. . | |
| 4,059,248 | 11/1977 | Kuntz . | |
| 4,079,841 | 3/1978 | Castel . | |
| 4,081,080 | 3/1978 | Rorex . | |
| 4,083,456 | 4/1978 | Genn et al. . | |
| 4,162,014 | 7/1979 | Bobrick . | |
| 4,550,893 | 11/1985 | Wiersema et al. . | |
| 4,588,094 | 5/1986 | Evans | 211/55 |
| 5,016,760 | 5/1991 | Mayo | 211/88 X |

*Primary Examiner*—Robert W. Gibson, Jr.
*Attorney, Agent, or Firm*—Price, Gess & Ubell

[57] ABSTRACT

A pocket wall file apparatus that is aesthetically pleasing, structurally effective, and cost efficient. The apparatus consists of identical pocket modules having no removable parts. A hidden interconnection structure on the back wall of each pocket module is used for attaching one or more pocket modules together adjacent to and, regardless of the number of interconnected modules, flush with a supporting wall. The interconnection structure consists of mating hook and aperture portions. Beneficially, only three screws are needed to mount any number of pocket modules to a wall. An uppermost module is hung on two screws and the lowermost module rests upon a third screw. Any other interconnected modules are supported below and above the uppermost and lowermost modules through the hidden interconnection structure.

16 Claims, 4 Drawing Sheets

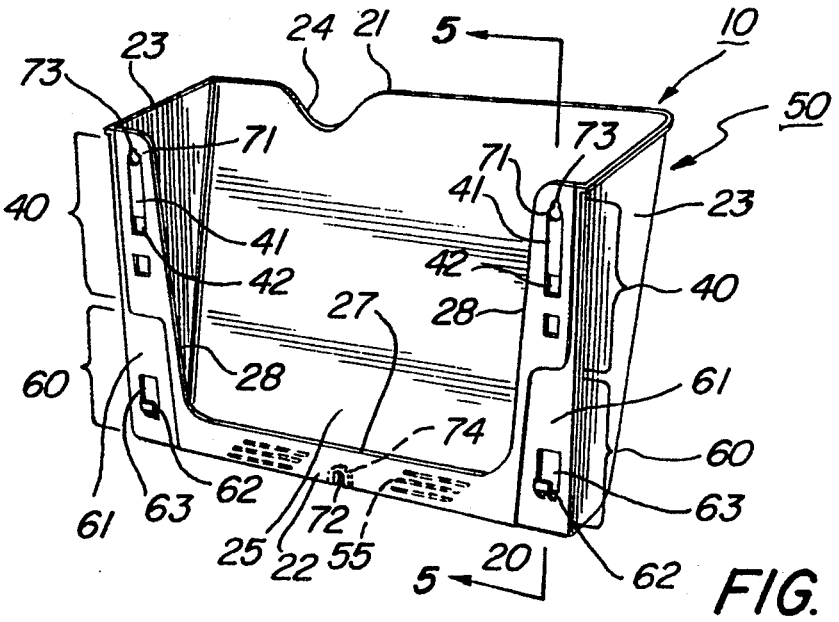
FIG. 1
FIG. 2
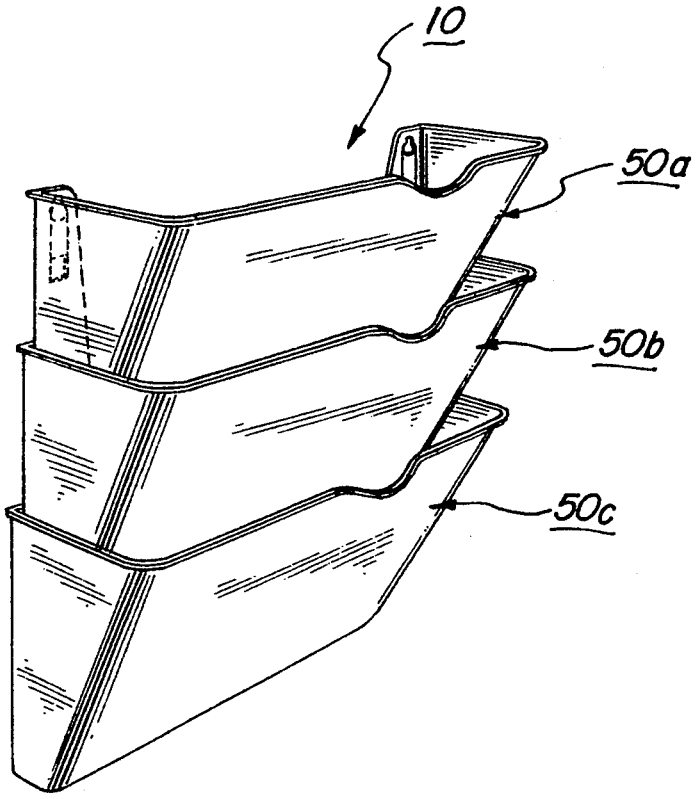

EXPANDABLE MODULAR WALL FILE WITH HIDDEN ATTACHMENT AND SUPPORT MEANS

BACKGROUND OF THE INVENTION

1. Field of the Invention

The present invention relates generally to document filing apparatus and, more particularly, to a modular expandable wall-mounted filing apparatus comprised of identical pocket modules that fit into and interlock with one another to provide a convenient, attractive, quick-access, and space-saving system for storing documents.

2. Description of Related Art

Over the years, countless apparatus have been used to file and store documents in the office environment. Examples of such filing devices include desk trays, often used as "In" and "Out" boxes, and vertical sorters, often used to hold telephone messages. The foregoing filing apparatus are typically used on a flat surface like a desktop.

The present invention relates to filing apparatus that are mounted on vertical walls. Such apparatus are, as would be expected, known generally as wall files. In its most basic form, a wall file is comprised of an open-ended document container mounted to the wall. The wall could, of course, form the back side of the open-ended container.

Wall files having several document containers became popular in response to consumer desire to store and access several different kinds of documents in a single location. Many such wall files came with a fixed number of document containers, which detrimentally offer too few or too many document containers for the user's needs.

Expandable wall files became available so that users could set up a "customized" wall file having a desired number of document containers such as 2, 3, 4, etc.

Unfortunately, the expandable wall files of the prior art have many limitations. Such expandable wall files often consist of a primary pocket module and secondary pocket modules which are constructed differently. The user typically mounts the primary module to the wall and then hangs one or more of the second modules below the primary module. If the primary pocket module breaks, the user cannot replace it with a secondary pocket module, but rather must replace it with a primary module. Moreover, such a system requires two different molds to manufacture the two different modules. The consumer ultimately pays the price in terms of convenience and expense.

Other prior expandable wall files have a plurality of parts wherein the individual pocket modules require assembly before, and sometimes after, engagement with additional pocket modules. If one of the module parts becomes lost or broken, the wall file may not be functional or constructable.

Other prior expandable wall files require the user to attach a bracket to the wall before the pocket modules can be attached. Other known wall files are attached to the wall using screw apertures which are highly visible to the user and detract from the appearance of the wall file. Some previous wall files require screw apertures for each module, resulting in added hardware and lengthy installation.

As to attaching one module to another, the known expandable wall files have connection joints located on the sides or front wall of the module. These joints are often highly visible, even after attachment, thereby detracting from the appearance of the wall file. For example, in one known wall file system, the parallel side walls of the second module have inwardly-facing tabs that are stretched to fit over and into slots on the parallel side walls of the first module. This structure makes it possible to break the second module when stretching its sides. Moreover, the connection between modules is structurally insecure and unattractive.

Other prior expandable wall files use an attachment means that require removal of a piece of the first module, such as the front wall, in order to slide a back side of the second module into grooves located in the front of the first module. This system creates the risk of losing or breaking the removed pieces during the interim, and also requires several expensive molds for making the several components.

OBJECTS AND SUMMARY OF THE INVENTION

The present invention addresses several of the shortcomings and disadvantages of the prior wall files.

One object of the invention is to provide an expandable pocket wall file that consists of integral identically-constructed pocket modules that can be attached to each other in any desired order. Thus, if any of the pocket modules are broken or lost, they can be replaced with any other pocket modules. In addition, the pocket modules have no removable pieces. As a result, only one mold is needed to create the modules, making the overall product less expensive to the consumer.

Another object of the present invention is providing a means for interconnecting one module to another that is hidden from view.

Another object of the present invention is to provide a hidden, simplified support means for attaching the apparatus to a wall or other vertical support surface. The present invention requires only three screw apertures, which are placed in the back wall, regardless of the number of interconnected modules. Preferably, the upper circumference of the screw apertures is thicker to provide added strength. Beneficially, no additional parts or pieces are required besides screws.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 1 is a rear perspective view of a single pocket module 50 according to the present invention;

FIG. 2 is a front perspective of a three-pocket wall file structure 10, according to the present invention, comprised of three interconnected pocket modules 50*a*, 50*b*, 50*c*, the middle module 50*b* being suspended from the upper module 50*a*, and the bottom module 50*c* being suspended from the middle module 50*b*.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a pocket wall file apparatus constructed in accordance with the teachings of the invention shown in FIGS. 1–6 of the drawings.

Figure 3:
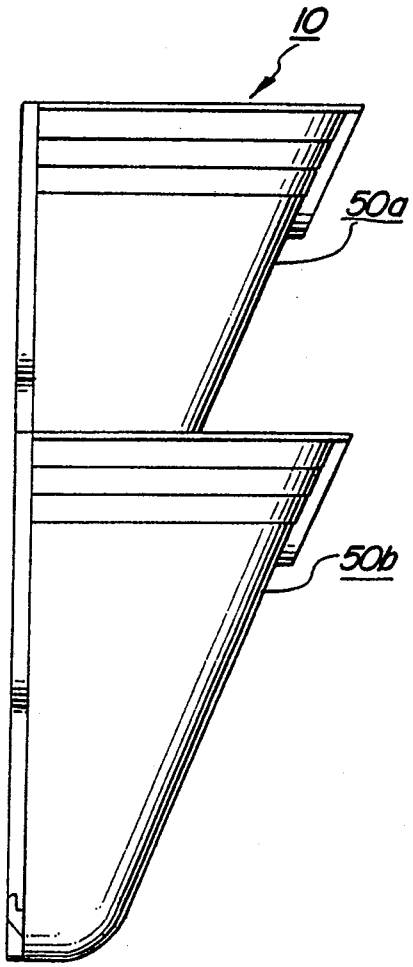
FIG. 3 is a side view of a two-pocket wall file structure 10 comprised of two interconnected pocket modules 50*a*, 50*b*.
Figure 4:
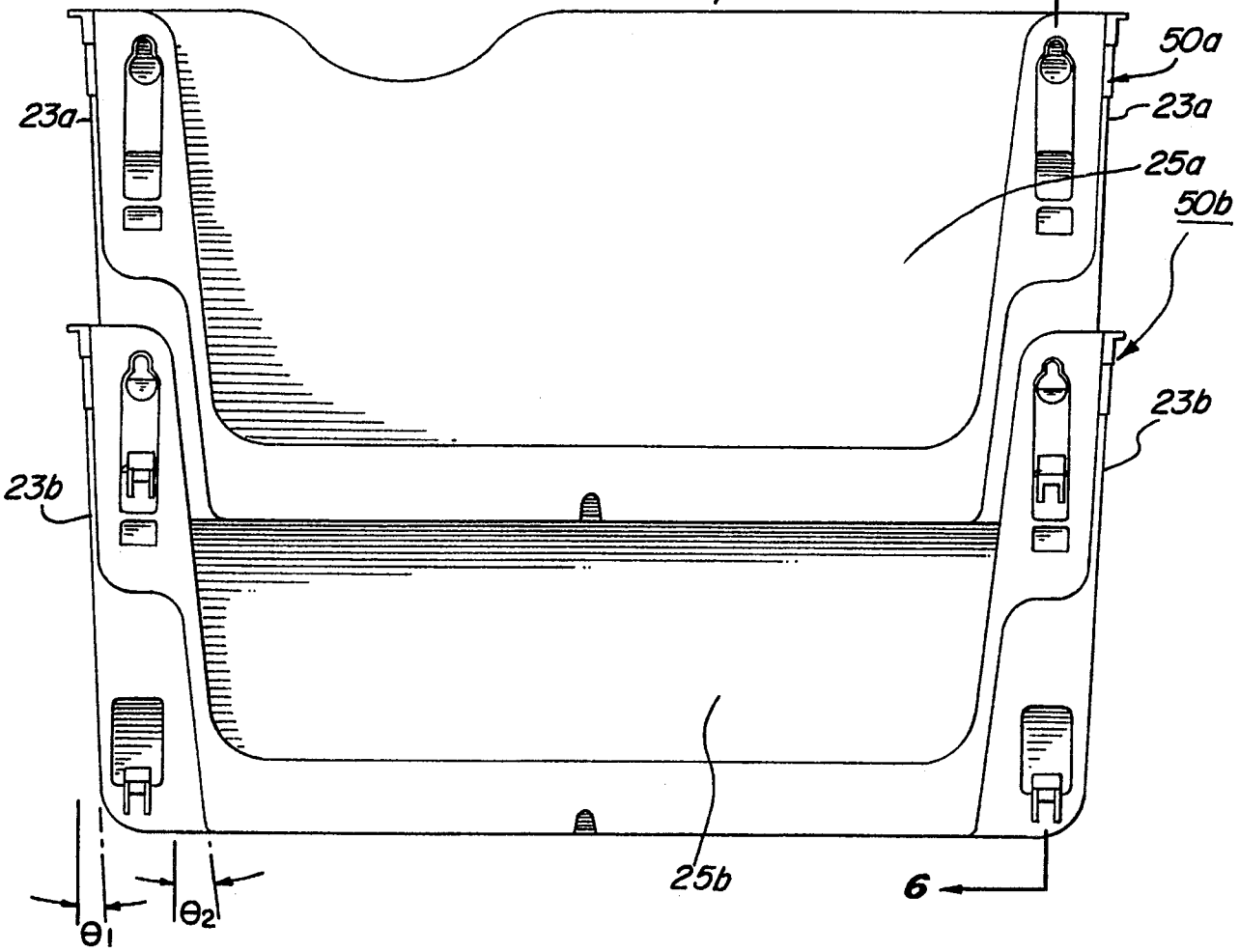
FIG. 4 is a rear view of the two-pocket wall file structure of FIG. 3.

FIG. 1 shows the back side of a single pocket module 50. A wall file structure 10 according to the present invention is comprised of one or more identical pocket modules 50.

Where believed helpful, the same components of separate but connected pocket modules 50 will be referenced with the same numeric identifiers followed by the letters "a," "b," "c," etc. Following this nomenclature, FIGS. 1 and 5 depict a wall file structure 10 comprised of one module 50, FIGS. 3, 4, and 5 depict a wall file structure 10 comprised of two modules 50*a*, 50*b*, and FIG. 2 depicts a wall file structure 10 comprised of three modules 50*a*, 50*b*, 50*c*.

The preferred pocket modules 50 are fabricated from various types of synthetic plastic materials by using an injection molding process. As is well known to those skilled in the art, various equivalent methods and materials may be utilized to fabricate the pocket modules.

The preferred pocket module 50 of FIG. 1 includes a bottom 20, a front wall 21, a back wall 22, and a pair of side walls 23, 23.

Figure 5:
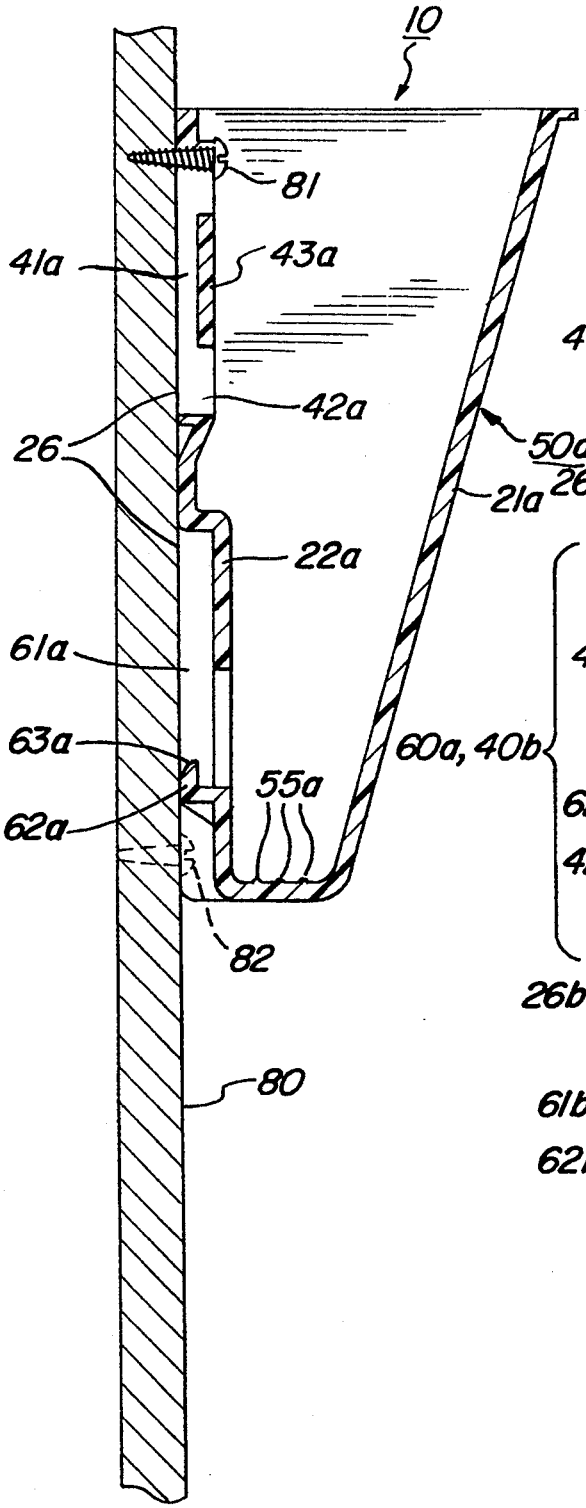
FIG. 5 is a cross-sectional view of the pocket module 50 of FIG. 1, taken along section lines 5—5, with the module attached flush to a wall.

As shown in FIG. 5, each pocket module 50*a* of the wall file structure 10 is specifically designed for attachment to a vertical support surface such as a wall 80. To this end, the pocket module's back wall 22 includes a rearwardly-facing planar contact surface 26 that contacts the wall 80. The planar contact surface 26 covers all of the back wall 22 except for left and right recessed portions 61, 61, and a large central opening 25. The planar contact surface 26 is preferably present along most of the vertical height of the back wall 22 or, alternatively, at several strategic points, in order to allow sufficient vertical contact between the planar contact surface 26 and the wall 80.

Figure 6:
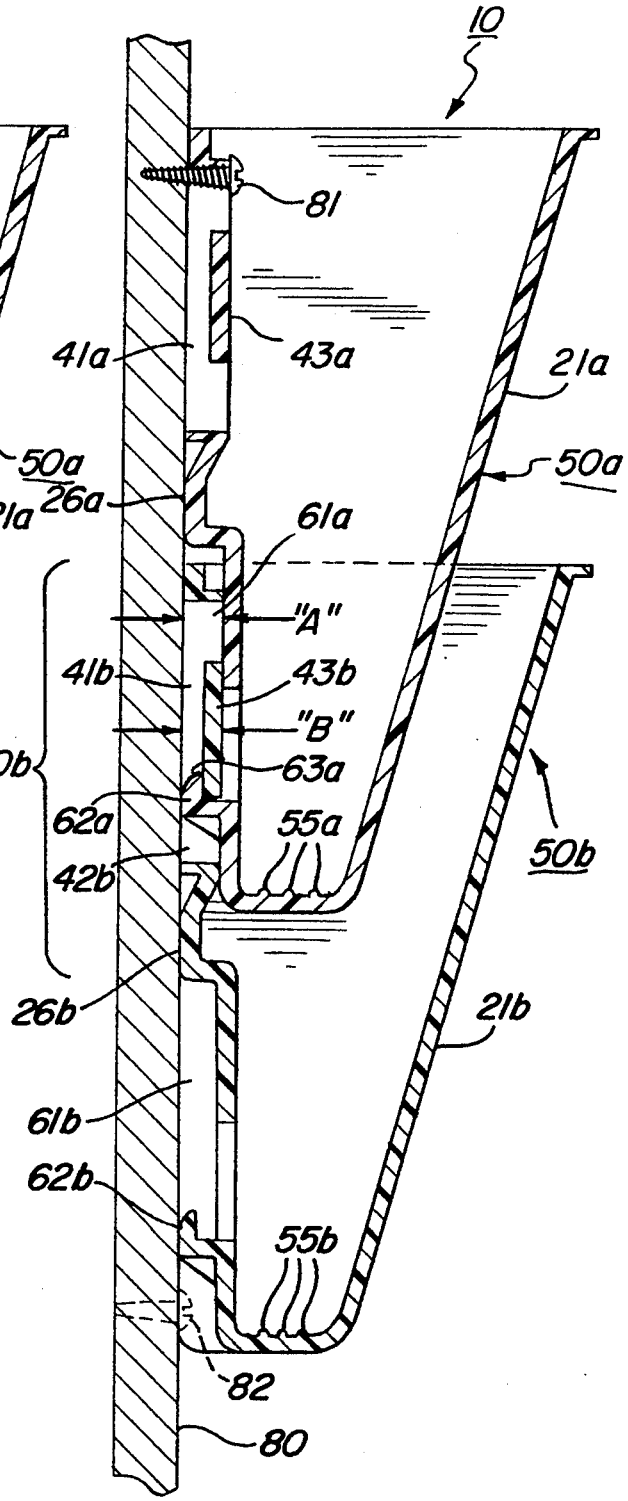
FIG. 6 is a cross-sectional view of the two interconnected modules 50*a*, 50*b* of FIG. 4, taken along section lines 6—6, with both modules attached flush to a wall.

As shown in FIGS. 5 and 6, the front wall 21 extends outward at an angle relative to the vertical to form a triangular cross-section. As shown in FIG. 4, the side walls 23 also extend outwardly at an angle $\theta_1$ relative to the vertical, on both sides, to form a wedge-shaped cross-section. The large central opening 25, located centrally in the planar contact surface 26, is defined by a peripheral bottom edge 27 and peripheral side edges 28. The peripheral side edges 28 are, as shown in FIG. 4, also at an angle $\theta_2$ relative to the vertical so that the planar contact surface 26 is also wedge-shaped.

The triangular and wedge-shaped cross-sections, being smaller at the bottom than at the top, allow a first upper pocket module 50*a* to fit into a second lower pocket module 50*b*. The angle of the front wall 21 also facilitates access to papers (not shown) stored in the pocket module 50. As shown in FIG. 1, a notch 24 may also be provided in a top edge of the front wall 21 to lend further access to papers located within the pocket module 50.

An interconnected suspending means for suspending one module from another, as shown in FIG. 6, allows the contact surfaces 26*a*, 26*b* of multiple interconnected modules to lie flat against the wall 80. Thus, no matter how many modules (e.g. 50*a*, 50*b*, 50*c*, etc. . . . ) are connected together, the contact surfaces 26 of all such modules 50 will lie flat against and in contact with the wall 80. The contact between the wall 80 and all of the interconnected modules saves space and avoids problems that would arise if multiple modules were cantilevered from some smaller connection area.

Figure 8:
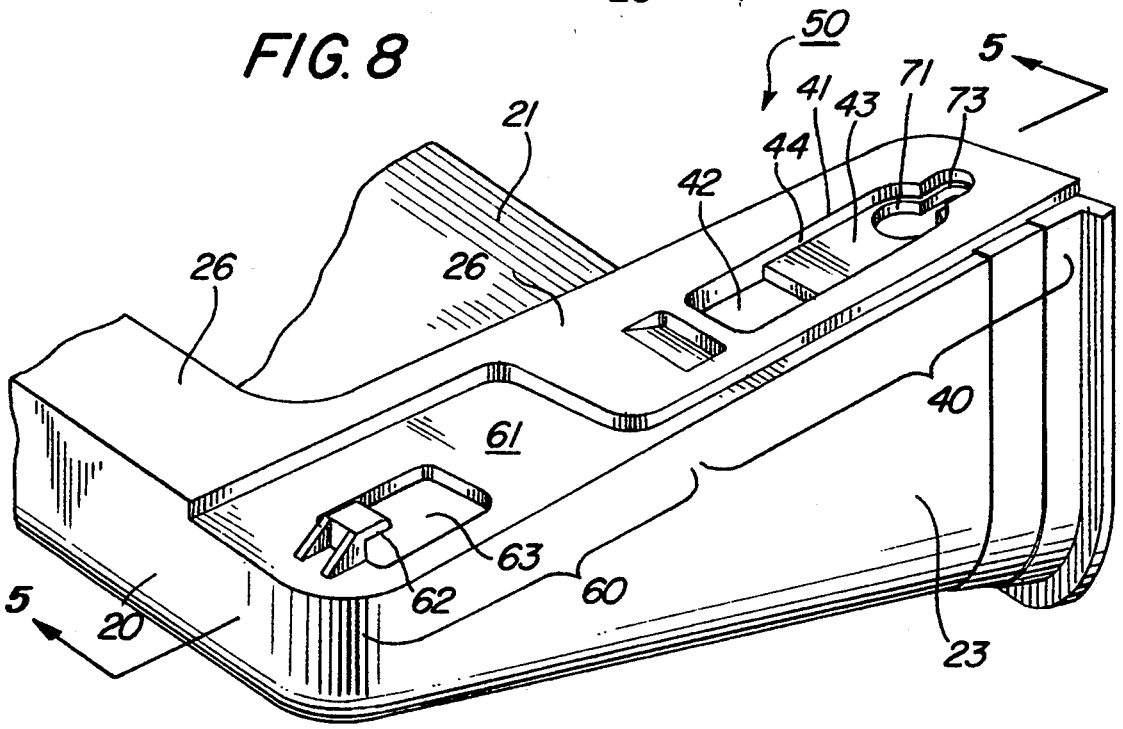
FIG. 8 is a perspective view of the preferred interconnecting structure located at the rear right-hand side of the module 50 of FIG. 1.

As shown in FIGS. 1 and 8, each pocket module 50 includes two operative halves of the preferred means for interconnecting multiple modules. An upper half of the interconnected suspending means is comprised of an aperture portion 40 and a lower half is comprised of a hook portion 60. The interconnected suspending means are preferably located entirely on the module's back wall 22 so that the resulting joint is hidden from view after connection.

Because the preferred module 50 includes the large central opening 25, the module 50 uses two hook sections 60, 60 and two aperture sections 40, 40, one of each kind on opposite sides of the central opening 25. However, it should be readily understood that one hook portion 60 and one aperture portion 40 would suffice in other embodiments.

Each preferred hook portion 60 is comprised of the recess 61, located on an external lower side of the back wall 22, and an L-shaped hook 62 extending outwardly from the recess. A through-hole 63 is provided adjacent to the L-shaped hook 62 to help facilitate the preferred injection molding procedure.

Each preferred aperture portion 40 is comprised of a substantially rectangular recess 41 located on an upper side of the back wall 22 and an aperture 42 extending through the back wall 22 at a bottom end of the rectangular recess 41. The rectangular recess 41 is defined, as shown in FIG. 8, by a side wall 41 and a bottom wall 43. The aperture 42 and the rectangular recess 41 are sized to receive another module's L-shaped hook 62, as shown in FIG. 6.

FIG. 6 shows a lower module 50*b* suspended from an upper module 50*a*. As shown, the hook portion 60*a* of the upper module 50*a* mates with the aperture portion 40*b* of the lower module 50*b*. The hook portion 60 and aperture portion 40 are designed so that a depth "A" of the hook portion's recess 61*a* matches a combined width "B" of the aperture portion's rectangular aperture 41*b* and bottom wall 43*b*.

Because of this dimensional relationship, the lower module 50*b* can hang straight down from the upper module 50*a* along the wall 80. This straight down flush-with-the-wall relationship would exist, from module-to-module, regardless of the number of interconnected modules.

A preferred means for attaching the module 50 to the wall 80 is comprised of a two upper screw apertures 71, 71, one lower screw aperture 72, two upper screws 81, 81, and one lower screw 82. The upper screw apertures 71, 71 are keyhole-shaped to form a narrow upper portion 73, 73 that retains the module 50 behind the heads of the screws 81, 81. The lower screw aperture 72, as most clearly shown in FIG. 7, includes a rectangular notch 75 which allows the module 50 to be dropped onto the lower screw 82 after it has been partially screwed into the wall 80.

In the case of only one module 50*a*, as shown in FIG. 5, the upper screws 81, 81 and the lower screw 82 are all used to secure that one module 50*a* against the wall 80. However, in the case of two or more modules 50*a*, 50*b*, etc. . . . , as shown in FIG. 6, the upper screws 81, 81 are used to secure the topmost module 50*a*, and the lower screw 82 is used to secure the lowermost module 50*b*. Beneficially, no screws are needed for any modules located between the topmost module and the lowermost module. For example, referring to FIG. 2, two upper screws 81, 81 (not shown) are used to secure topmost module 50*a*, and one lower screw 82 (not shown) is used to secure the lowermost module 50*c*. Screws are not needed to secure the middle module 50*b*. Instead, the middle module 50*b* is entirely supported by its connection to the topmost module 50*a*.

Figure 7:
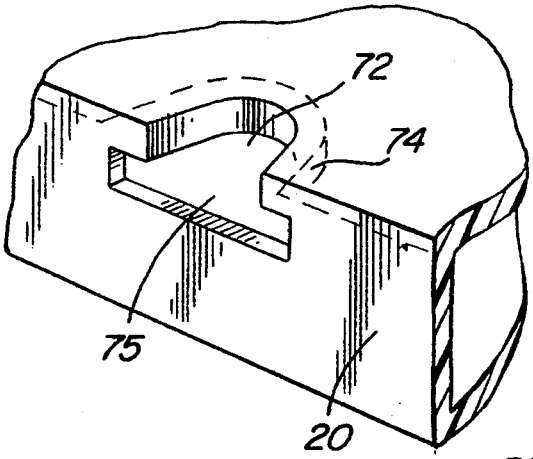
FIG. 7 is a perspective view of a lower screw aperture 72 located at the bottom of the module of FIG. 1.

The upper and lower screw apertures 71, 71, 72 are preferably thicker at their upper circumference to give added strength. FIG. 7 most clearly shows the addition of a preferred double-thick boss 72 located around the upper circumference of the screw aperture 72. Preferably, the upper screw apertures are similarly reinforced.

The preferred module 50 also includes a plurality of ridges 55 located on an interior surface of the bottom wall 20 to help prevent documents within the pocket module 50 from sliding.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A module expandable wall file apparatus comprising:

at least first and second identical separable pocket modules, each pocket module having an interior defined by a bottom, a substantially vertical back wall, a front wall extending outwardly at an angle from the vertical, and first and second side walls extending outwardly at an angle from the vertical, whereby a bottom end of the first pocket module may fit into a top end of the second pocket module such that a portion of their respective back walls are adjacent to one another;

hidden interconnected suspending means, located on the back wall of each pocket module, for interconnecting and suspending the back wall of the second module from the back wall of the first module; and means for attaching at least the first one of the interconnected suspended pocket modules to the wall.

2. The pocket wall file apparatus of claim 1, wherein each pocket module is further comprised of a notch at a top end of the front wall to facilitate access to the interior of the pocket module.

3. The pocket wall file apparatus of claim 1, wherein the interconnected suspending means is comprised of hook portions defined at a lower end of the back wall of each module and aperture portions defined at an upper end of the back wall of each module.

4. The pocket wall file apparatus of claim 3 wherein the hook portions are comprised of:

a raised contact surface on the back wall of each module, said contact surface covering most of the back wall except for a lower left portion of the back wall and a lower right portion of the back wall which respectively define lower left and lower right recesses that receive the raised contact surface of another interconnected module such that the raised contact surfaces are flush with one another; and an L-shaped hook extending outwardly from said lower left and right portions of the back wall.

5. The pocket wall file apparatus of claim 4 wherein the aperture portions are comprised of:

rectangular depressions formed in an upper left portion of the back wall and in an upper right portion of the back wall; and apertures formed through the back wall at a bottom end of each rectangular depression, said rectangular depressions and said apertures having a width sized to receive the L-shaped hook members of said hook portions.

6. The wall file apparatus of claim 1 wherein said attaching means is comprised of:

at least one upper screw aperture at a top end of the back wall of each pocket module whereby said first module may be attached to the wall with a screw and said second module, along with any other intermediate modules, are interconnected to said first module by way of the interconnected suspending means.

7. The wall file apparatus of claim 6 wherein said attaching means is further comprised of:

a lower screw aperture at a bottom end of the back wall of each pocket module whereby, when a plurality of pocket modules are interconnected to one another, the lower screw aperture of a bottom most one of said pocket modules may be attached to the wall with a screw thereby securing the entire plurality of pocket modules flush to the wall.

8. The wall file apparatus of claim 7 wherein an upper circumferential wall of said screw apertures is thicker to provide added support strength.

9. A modular expandable wall-file system for use in storing documents on a wall comprising:

at least first and second identical pocket modules, each pocket module comprised of a substantially vertical back wall, having an upper side and a lower side, and a front wall, said back and front walls defining an interior of said each pocket module for receiving the documents;

said front wall of each pocket module extending outwardly at an angle from said back wall of each pocket module to form a substantially triangular cross-section such that a bottom end of said first pocket module may be inserted into a top opening of said second module with the interior of the second module still accessible in a space formed between the front walls of the respective modules;

means for interconnecting said first and second modules comprised of:

a hook portion on the lower back wall of the first module comprised of a recess and an L-shaped hook member extending outwardly therefrom;

an aperture portion on the upper back wall of the second module comprised of an aperture and a substantially rectangular recess adjacent to said aperture for receiving the first module's L-shaped hook member when the bottom end of the first module is inserted into the top opening of the second module with the lower back wall of the first module adjacent to the upper back wall of the second module, said hook and aperture portions being located entirely on the back walls of the respective modules so that the interconnecting means is not visible after the modules are mounted against the wall; and said hook and aperture portions being dimensioned such that, after interconnection, the back walls of the first and second modules are flush with one another against the wall.

10. The modular expandable wall-file system of claim 9 further comprising means for attaching the first and second modules to the wall comprised of:

at least one screw aperture located in the upper back wall of said each module, whereby said at least one screw aperture of the first pocket module may be used to mount the first pocket module to the wall and whereby, due to the interconnecting means between the first and second pocket modules, the second pocket module is also supported by said at least one screw aperture of the first pocket module; and at least one screw aperture located in the lower back wall of each said module, whereby said at least one screw aperture of the second pocket module may be used to retain the back walls of the first and second modules flush against the wall.

11. The modular expandable wall-file system of claim 9 wherein the front wall of said each pocket module includes a notch to facilitate access to the documents stored therein.

12. A module expandable wall file apparatus comprising:

at least first and second separate identical pocket modules, each pocket module having an interior defined by a bottom, a substantially vertical back wall, a front wall extending outwardly at an angle from the vertical, and first and second side walls extending outwardly at an angle from the vertical, whereby a bottom end of the first pocket module may fit into a top end of the second pocket module such that a portion of their respective back walls are adjacent to one another;

hidden interconnecting means, located on the back wall of each pocket module, for interconnecting the back wall of the first pocket module to the back wall of the second pocket module, wherein the interconnecting means is comprised of hook portions defined at a lower end of the back wall of each module and aperture portions defined at an upper end of the back wall of each module; and means for attaching the interconnected pocket modules to the wall.

13. The pocket wall file apparatus of claim 12 wherein the hook portions are comprised of:

a raised contact surface on the back wall of each module, said contact surface covering most of the back wall except for a lower left portion of the back wall and a lower right portion of the back wall which respectively define lower left and lower right recesses that receive the raised contact surface of another interconnected module such that the raised contact surfaces are flush with one another; and an L-shaped hook extending outwardly from said lower left and right portions of the back wall.

14. The pocket wall file apparatus of claim 12 wherein the aperture portions are comprised of:

rectangular depressions formed in an upper left portion of the back wall and in an upper right portion of the back wall; and apertures formed through the back wall at a bottom end of each rectangular depression, said rectangular depressions and said apertures having a width sized to receive the L-shaped hook members of said hook portions.

15. The wall file apparatus of claim 12 wherein said attaching means is comprised of:

at least one upper screw aperture at a top end of the back wall of each pocket module whereby said first module may be attached to the wall with a screw and said second module, along with any other intermediate modules, are interconnected to said first module by way of the interconnecting means.

16. The wall file apparatus of claim 12 wherein said attaching means is further comprised of:

a lower screw aperture at a bottom end of the back wall of each pocket module whereby, when a plurality of pocket modules are interconnected to one another, the lower screw aperture of a bottom most one of said pocket modules may be attached to the wall with a screw thereby securing the entire plurality of pocket modules flush to the wall.

* * * * *